US009620047B2

(12) United States Patent
Lee et al.

(10) Patent No.: US 9,620,047 B2
(45) Date of Patent: Apr. 11, 2017

(54) DISPLAY DEVICE AND METHOD OF OPERATING DISPLAY DEVICE INCLUDING SHIFTING AN IMAGE DISPLAY REFERENCE COORDINATE

(71) Applicant: SAMSUNG DISPLAY CO., LTD., Yongin, Gyeonggi-Do (KR)

(72) Inventors: Kang-Hee Lee, Suwon-si (KR); Mi-Young Joo, Hwaseong-si (KR); Myung-Hee Han, Seoul (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 126 days.

(21) Appl. No.: 14/662,462

(22) Filed: Mar. 19, 2015

(65) Prior Publication Data

US 2016/0111034 A1 Apr. 21, 2016

(30) Foreign Application Priority Data

Oct. 21, 2014 (KR) ..... 10-2014-0142833

(51) Int. Cl.
*G09G 3/00* (2006.01)
*G09G 3/20* (2006.01)

(52) U.S. Cl.
CPC ..... *G09G 3/007* (2013.01); *G09G 3/20* (2013.01); *G09G 2320/0257* (2013.01); *G09G 2320/046* (2013.01); *G09G 2340/045* (2013.01); *G09G 2340/0414* (2013.01); *G09G 2340/0464* (2013.01)

(58) Field of Classification Search
None
See application file for complete search history.

(56) References Cited

U.S. PATENT DOCUMENTS 5,966,691 A * 10/1999 Kibre ..... G10L 13/00 704/260
2005/0018046 A1* 1/2005 Tsuzuki ..... G09G 3/007 348/173
2008/0174518 A1* 7/2008 Sakuragi ..... G09G 3/22 345/10
2008/0211802 A1 9/2008 Yun et al.
2008/0316318 A1* 12/2008 Hoffman ..... H04N 5/7416 348/177
2011/0095974 A1* 4/2011 Moriwaki ..... G09G 3/007 345/156
2012/0236040 A1* 9/2012 Eom ..... G09G 3/007 345/681
2015/0054814 A1* 2/2015 Takeda ..... G09G 3/3208 345/212

FOREIGN PATENT DOCUMENTS

JP 2000-0231364 A 8/2000
KR 10-2003-0032564 A 4/2003
KR 10-2005-0105574 A 11/2005
KR 10-2006-0105840 A 10/2006
KR 10-2007-0010710 A 1/2007

* cited by examiner

*Primary Examiner* — Antonio Xavier
(74) *Attorney, Agent, or Firm* — Lee & Morse, P.C.

(57) ABSTRACT

A method of operating display device includes initializing an image display reference coordinate as a random coordinate among coordinates included in a shift pattern when power is applied to the display device, shifting the image display reference coordinate from the random coordinate along the shift pattern, and displaying an input image to a display panel included in the display device based on the image display reference coordinate.

15 Claims, 11 Drawing Sheets

| RN | IDRX | IDRY |
|---|---|---|
| 1 | -3 | -3 |
| 2 | -2 | -3 |
| 3 | -1 | -3 |
| 4 | 0 | -3 |
| 5 | 1 | -3 |
| ⋮ | ⋮ | ⋮ |
| 62 | 2 | 4 |
| 63 | 3 | 4 |
| 64 | 4 | 4 |

DISPLAY DEVICE AND METHOD OF OPERATING DISPLAY DEVICE INCLUDING SHIFTING AN IMAGE DISPLAY REFERENCE COORDINATE

CROSS-REFERENCE TO RELATED APPLICATION(S)

Korean Patent Application No. 10-2014-0142833, filed on Oct. 21, 2014, in the Korean Intellectual Property Office, and entitled: "Display Device and Method of Operating Display Device," is incorporated by reference herein in its entirety.

BACKGROUND

1. Field

Example embodiments relate generally to a display device. More particularly, embodiments relate to a method of operating a display device reducing an after-image.

2. Description of the Related Art

A display device, e.g. an organic light emitting diode (OLED) display device, a liquid crystal display (LCD) device, a plasma display device, and so forth, may generate an after-image after operating for a long time because the pixel circuits may be degraded.

A method of shifting an image slightly periodically on the display panel is developed to reduce the after-image. The method may reduce degradation of pixel circuit by preventing the pixel circuit outputting the same data for long time.

An image is displayed on the display panel based on the image display reference coordinate. The image display reference coordinate may shift in a shift pattern. If a start coordinate on the shift pattern is fixed and the display device is shut down and power is then restored to the display device, the image display reference coordinate may be reset to the start coordinate such that the image display reference coordinate may not encompass all of the shift pattern. In this case, after-image reduction efficiency may be decreased.

SUMMARY

According to some example embodiments, a method of operating a display device includes initializing an image display reference coordinate as a random coordinate among coordinates included in a shift pattern when power is applied to the display device, shifting the image display reference coordinate from the random coordinate along the shift pattern, and displaying an input image to a display panel included in the display device based on the image display reference coordinate.

In an example embodiment, initializing the image display reference coordinate as the random coordinate among the coordinates included in the shift pattern when the power is applied to the display device may include a generating a random value, and a setting the image display reference coordinate as a coordinate, which corresponds to the random value, among the coordinates included in the shift pattern.

In an example embodiment, the shift pattern may represent a shifting trace of the image display reference coordinate from a start coordinate to an end coordinate within a shift range.

In an example embodiment, displaying the input image on the display panel included in the display device based on the image display reference coordinate may include a generating an output image by processing the input image based the image display reference coordinate, and a displaying the output image on the display panel.

In an example embodiment, the image display reference coordinate may include an X-axis image display reference coordinate and a Y-axis image display reference coordinate.

In an example embodiment, generating the output image by processing the input image based on the image display reference coordinate may include a shifting the input image along the X-axis based on the X-axis image display reference coordinate, a generating an internal image by scaling the shifted input image along the X-axis, a shifting the internal image along the Y-axis based on the Y-axis image display reference coordinate, and a generating the output image by scaling the shifted internal image along the Y-axis.

In an example embodiment, the shifted input image along the X-axis may include a first partial image, a second partial image, and a third partial image. The first, second, and third partial images may be disposed sequentially along the X-axis. The third partial image may be not displayed on the display panel.

In an example embodiment, generating the internal image by scaling the shifted input image along the X-axis may include a generating a first extended partial image by extending the first partial image along the X-axis to fill a blank region of the display panel, and a generating the internal image by adding the first extended partial image and the second partial image. The blank region may be generated by the X-axis shift.

In an example embodiment, the shifted internal image along the Y-axis may include a first partial internal image, a second partial internal image, and a third partial internal image. The first, second, and third partial internal images may be disposed sequentially along the Y-axis. The third partial internal image may be not displayed on the display panel.

In an example embodiment, generating the output image by scaling the shifted internal image along the Y-axis may include a generating a first extended partial internal image by extending the first partial internal image along the Y-axis to fill a blank region of the display panel, and a generating the output image by adding the first extended partial internal image and the second partial internal image. The blank region may be generated by the Y-axis shift.

According to some example embodiments, a display device includes a timing controller, a display panel, a data driver, a scan driver, and a power controller. The timing controller includes a reference coordinate generator and an image processor. The reference coordinate generator initializes an image display reference coordinate as a random coordinate among coordinates included in a shift pattern when power is applied to the display device. The reference coordinate generator shifts the image display reference coordinate from the random coordinate along the shift pattern. The image processor generates an output image by shifting and scaling an input image based on the image display reference coordinate. The timing controller generates a data driver control signal and a scan driver control signal based on the output image. The display panel includes a plurality of pixel circuits. The data driver generates data signals based on the data driver control signal, and provides the data signals to the pixel circuits through a plurality of data lines. The scan driver generates scan signals based on the scan driver control signal, and provides the scan signals to the pixel circuits through a plurality of scan lines. The power controller provides a supply voltage and a ground voltage to the display panel to operate the display panel.

In an example embodiment, the reference coordinate generator may include a Radom value generator, and a look-up table (LUT). The random value generator may generate a random value. The look-up table may store coordinates included in the shift pattern. The look-up table may output a coordinate, which corresponds to the random value, among the coordinates as the image display reference coordinate.

In an example embodiment, the shift pattern may represent a shifting trace of the image display reference coordinate from a start coordinate to an end coordinate within a shift range.

In an example embodiment, the image display reference coordinate may include an X-axis image display reference coordinate and a Y-axis image display reference coordinate.

In an example embodiment, wherein the image processor may include an X-axis image processor and a Y-axis image processor. The X-axis image processor may shift the input image along the X-axis based on the X-axis image display reference coordinate, and generate an internal image by scaling the shifted input image along the X-axis. The Y-axis image processor may shift the internal image along the Y-axis based on the Y-axis image display reference coordinate, and generate the output image by scaling the shifted internal image along the Y-axis.

BRIEF DESCRIPTION OF THE DRAWINGS

Features will become apparent to those of skill in the art by describing in detail exemplary embodiments with reference to the attached drawings in which.

DETAILED DESCRIPTION

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. Like numerals refer to like elements throughout.

It will be understood that, although the terms first, second, third etc. may be used herein to describe various elements, these elements should not be limited by these terms. These terms are used to distinguish one element from another. Thus, a first element discussed below could be termed a second element without departing from the teachings herein. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular example embodiments only and is not intended to be limiting of the disclosure. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 1:
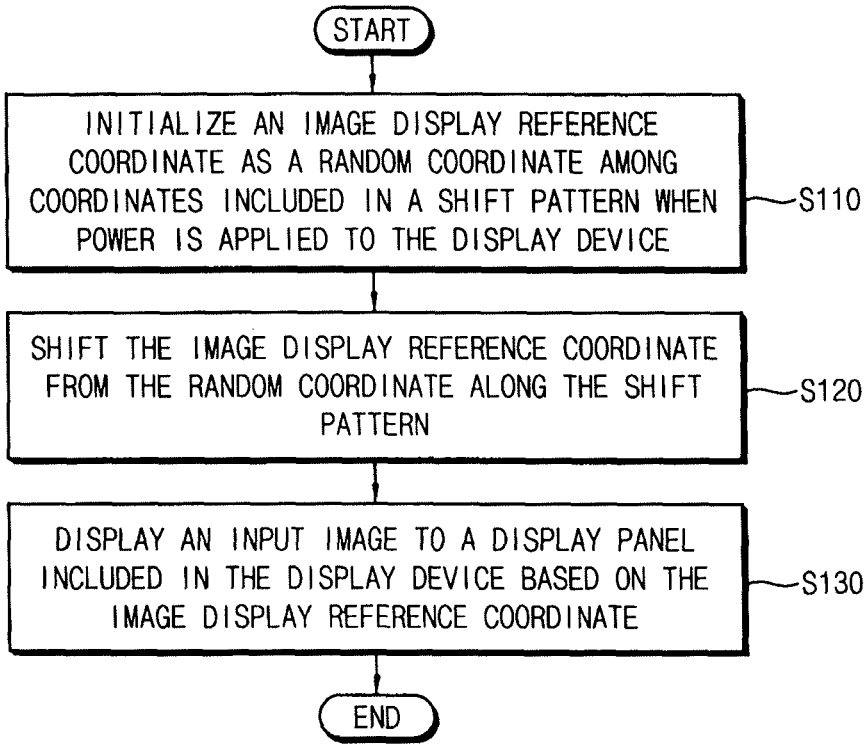
FIG. 1 illustrates a flow chart of a method of operating a display device according to an example embodiment.

FIG. 1 illustrates a flow chart of a method of operating a display device according to an example embodiment.

Referring to FIG. 1, a method of operating display device includes initializing an image display reference coordinate as a random coordinate among coordinates included in a shift pattern when power is applied to the display device (S110), shifting the image display reference coordinate from the random coordinate along the shift pattern (S120), and displaying an input image to a display panel included in the display device based on the image display reference coordinate (S130).

Initializing the image display reference coordinate as the random coordinate among the coordinates included in the shift pattern when the power is applied to the display device (S110) and shifting the image display reference coordinate from the random coordinate along the shift pattern (S120) will be described with the references to FIGS. 2, and 7 through 9.

Displaying the input image to the display panel included in the display device based on the image display reference coordinate (S130) will be described with the references to FIGS. 3 through 6, and FIGS. 10 through 12.

The image display reference coordinate may include an X-axis image display reference coordinate and a Y-axis image display reference coordinate.

Figure 2:
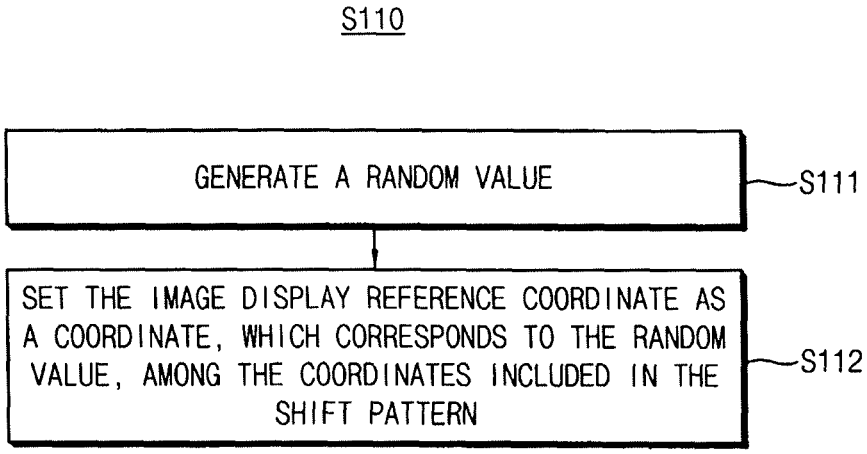
FIG. 2 illustrates a flow chart of initializing the image display reference coordinate as the random coordinate among coordinates included in the shift pattern when the power is applied to the display device included in the flow chart of FIG. 1.

FIG. 2 illustrates a flow chart of initializing the image display reference coordinate as the random coordinate among coordinates included in the shift pattern when the power is applied to the display device included in the flow chart of FIG. 1.

Referring to FIG. 2, initializing the image display reference coordinate as the random coordinate among the coordinates included in the shift pattern when the power is applied to the display device (S110) may include generating a random value (S111), and a setting the image display reference coordinate as a coordinate, which corresponds to the random value, among the coordinates included in the shift pattern (S112).

Generating the random value (S111) and setting the image display reference coordinate as the coordinate, which corresponds to the random value, among the coordinates included in the shift pattern (S112) will be described with the references to FIGS. 7 through 9.

Figure 3:
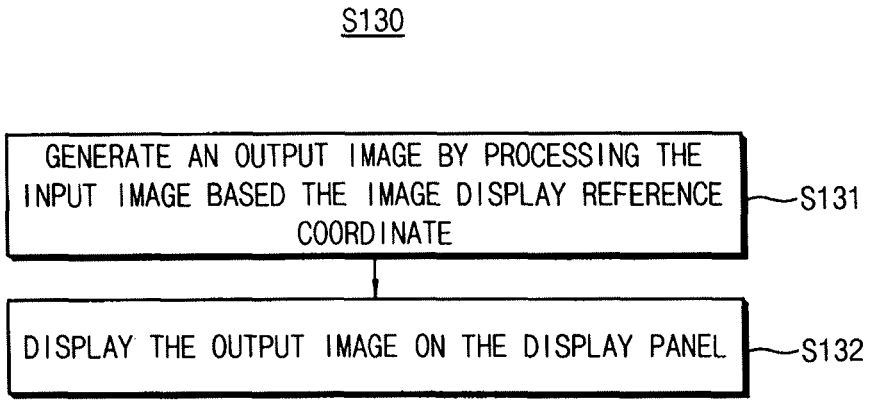
FIG. 3 illustrates a flow chart of displaying the input image on the display panel included in the display device based on the image display reference coordinate included in the flow chart of FIG. 1.

FIG. 3 illustrates a flow chart of displaying the input image on the display panel included in the display device based on the image display reference coordinate included in the flow chart of FIG. 1.

Referring to FIG. 3, displaying the input image on the display panel included in the display device based on the image display reference coordinate (S130) may include a generating an output image by processing the input image based the image display reference coordinate (S131), and displaying the output image on the display panel (S132).

Figure 4:
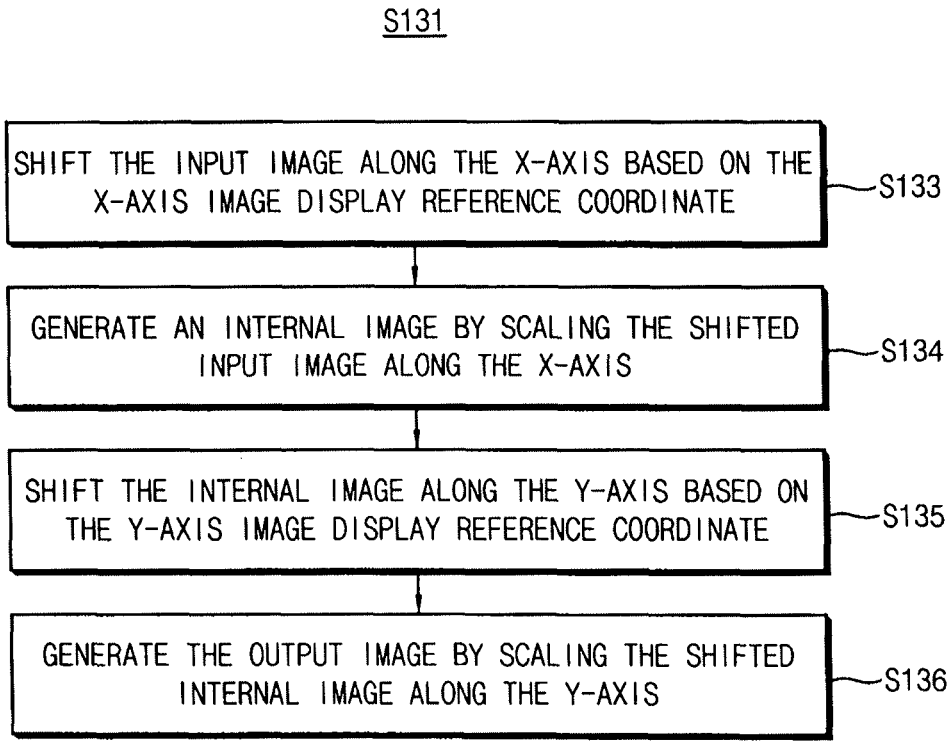
FIG. 4 illustrates a flow chart of generating the output image by processing the input image based the image display reference coordinate included in the flow chart of FIG. 3.

FIG. 4 illustrates a flow chart of generating the output image by processing the input image based the image display reference coordinate included in the flow chart of FIG. 3.

Referring to FIG. 4, generating the output image by processing the input image based on the image display reference coordinate (S131) may include a shifting the input image along the X-axis based on the X-axis image display reference coordinate (S133), a generating an internal image by scaling the shifted input image along the X-axis (S134), a shifting the internal image along the Y-axis based on the Y-axis image display reference coordinate (S135), and a generating the output image by scaling the shifted internal image along the Y-axis (S136).

Shifting the input image along the X-axis based on the X-axis image display reference coordinate (S133) will be described with the reference to FIG. 10. Shifting the internal image along the Y-axis based on the Y-axis image display reference coordinate (S135) will be described with the reference to FIG. 11.

Figure 5:
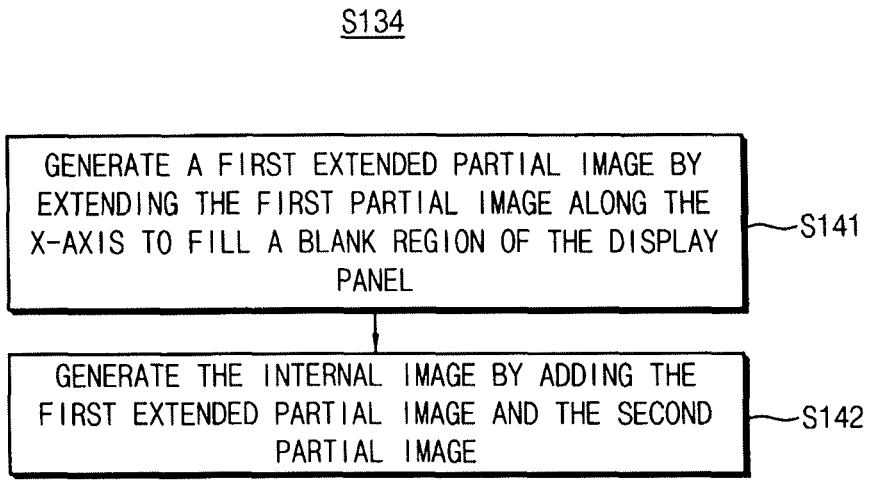
FIG. 5 illustrates a flow chart of generating the internal image by scaling the shifted input image along the X-axis included in the flow chart of FIG. 4.

FIG. 5 illustrates a flow chart of generating the internal image by scaling the shifted input image along the X-axis included in the flow chart of FIG. 4.

Referring to FIG. 5, generating the internal image by scaling the shifted input image along the X-axis (S134) may include a generating a first extended partial image by extending the first partial image along the X-axis to fill a blank region of the display panel (S141), and a generating the internal image by adding the first extended partial image and the second partial image (S142). The blank region may be generated by the X-axis shift.

The operations (S141 and S142) will be described with the references to FIGS. 10 and 12.

Figure 6:
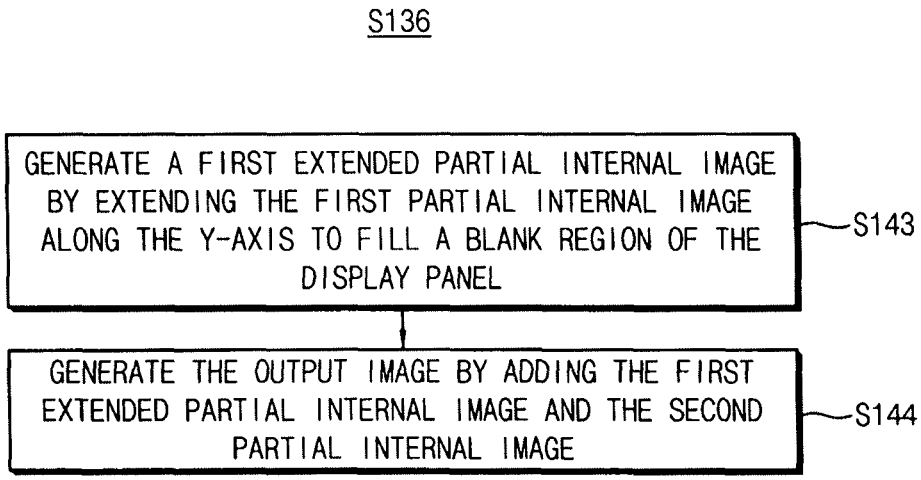
FIG. 6 illustrates a flow chart of generating the output image by scaling the shifted internal image along the Y-axis included in the flow chart of FIG. 4.

FIG. 6 illustrates a flow chart of generating the output image by scaling the shifted internal image along the Y-axis included in the flow chart of FIG. 4.

Referring to FIG. 6, generating the output image by scaling the shifted internal image along the Y-axis (S136) may include a generating a first extended partial internal image by extending the first partial internal image along the Y-axis to fill a blank region of the display panel (S143), and a generating the output image by adding the first extended partial internal image and the second partial internal image (S144). The blank region may be generated by the Y-axis shift.

The operations (S143 and S144) will be described with the references to FIGS. 11 and 12.

Figure 7:
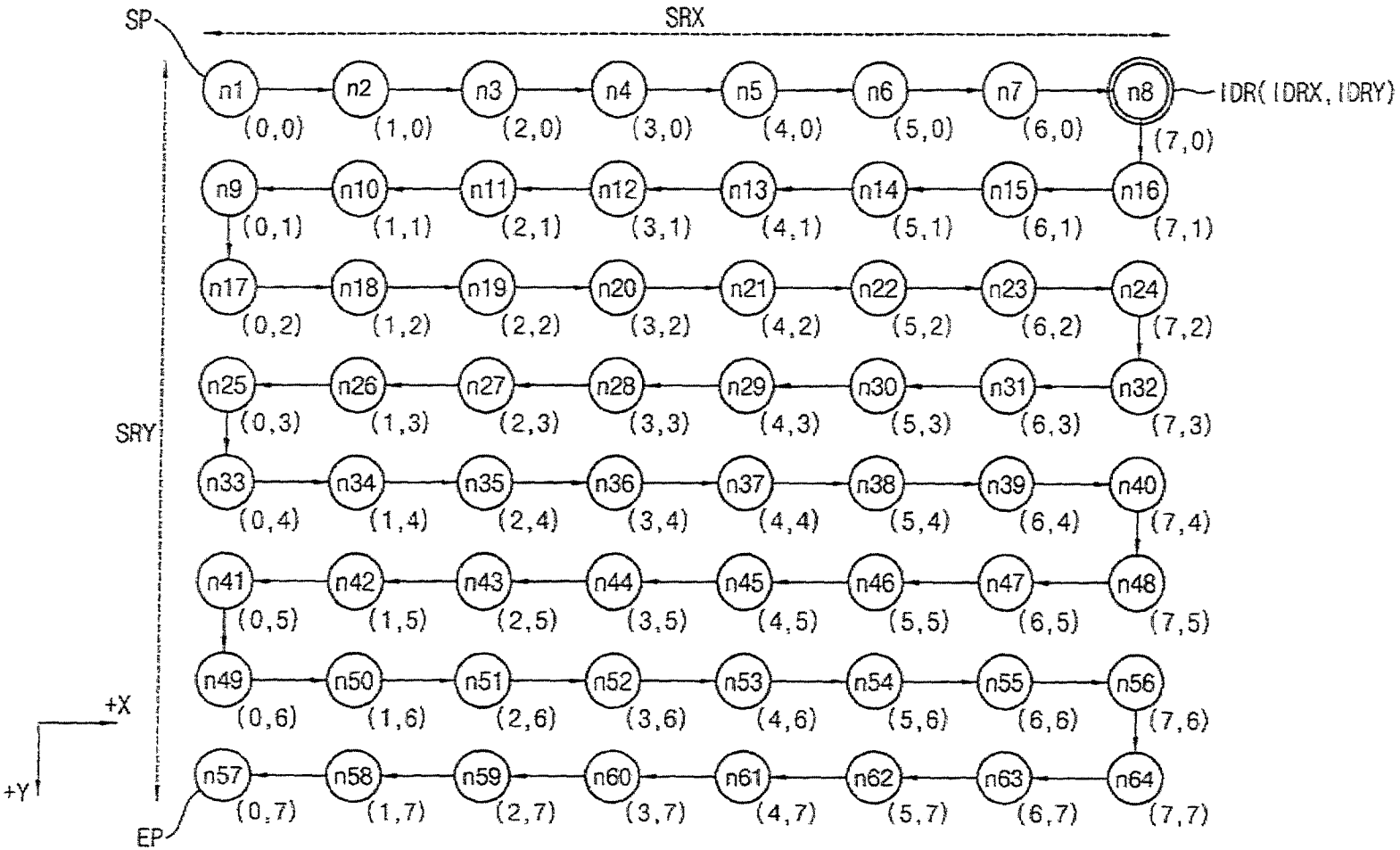
FIGS. 7 through 9 illustrate diagrams of example embodiments of the shift pattern.
Figure 8:
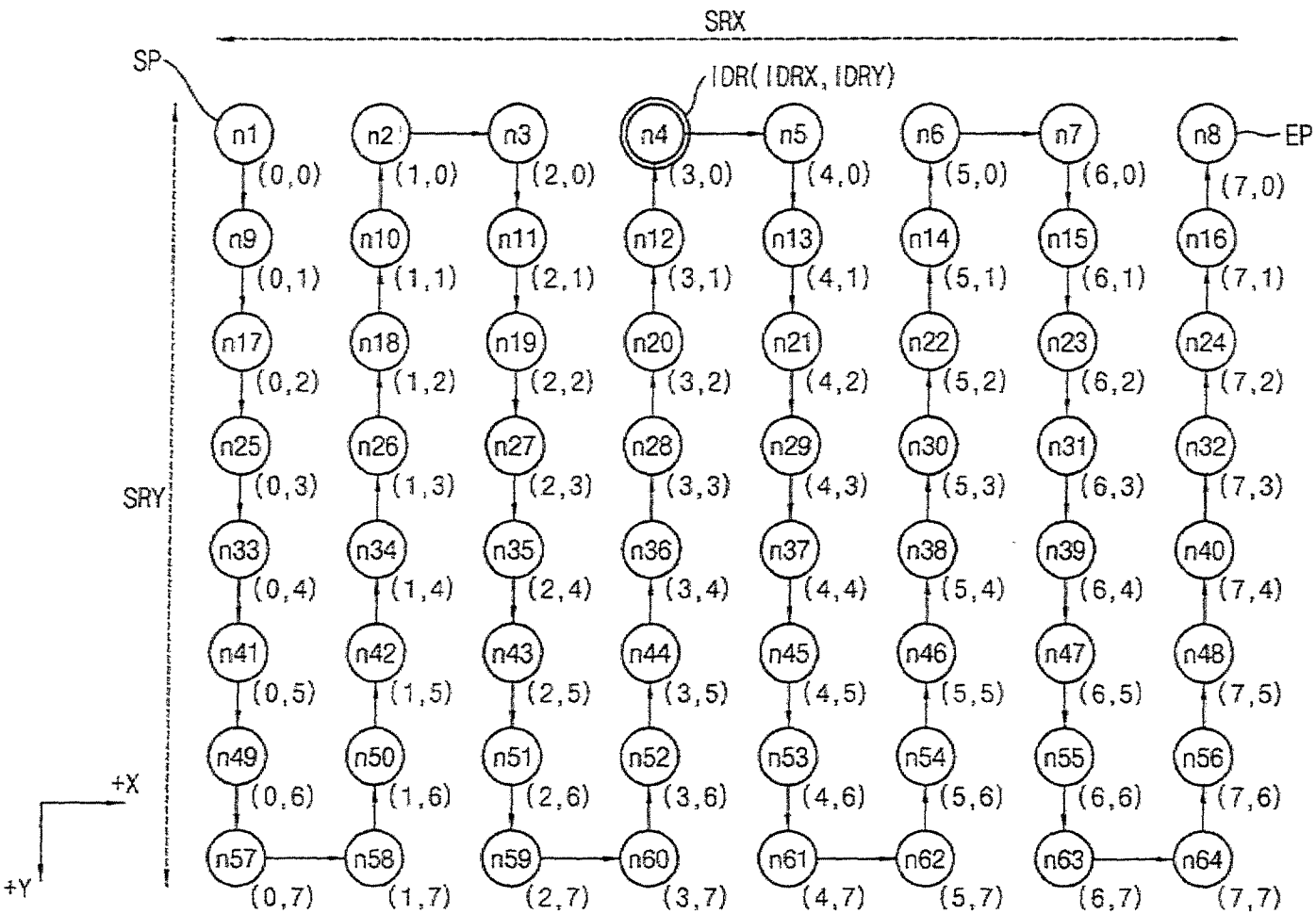
Figure 9:
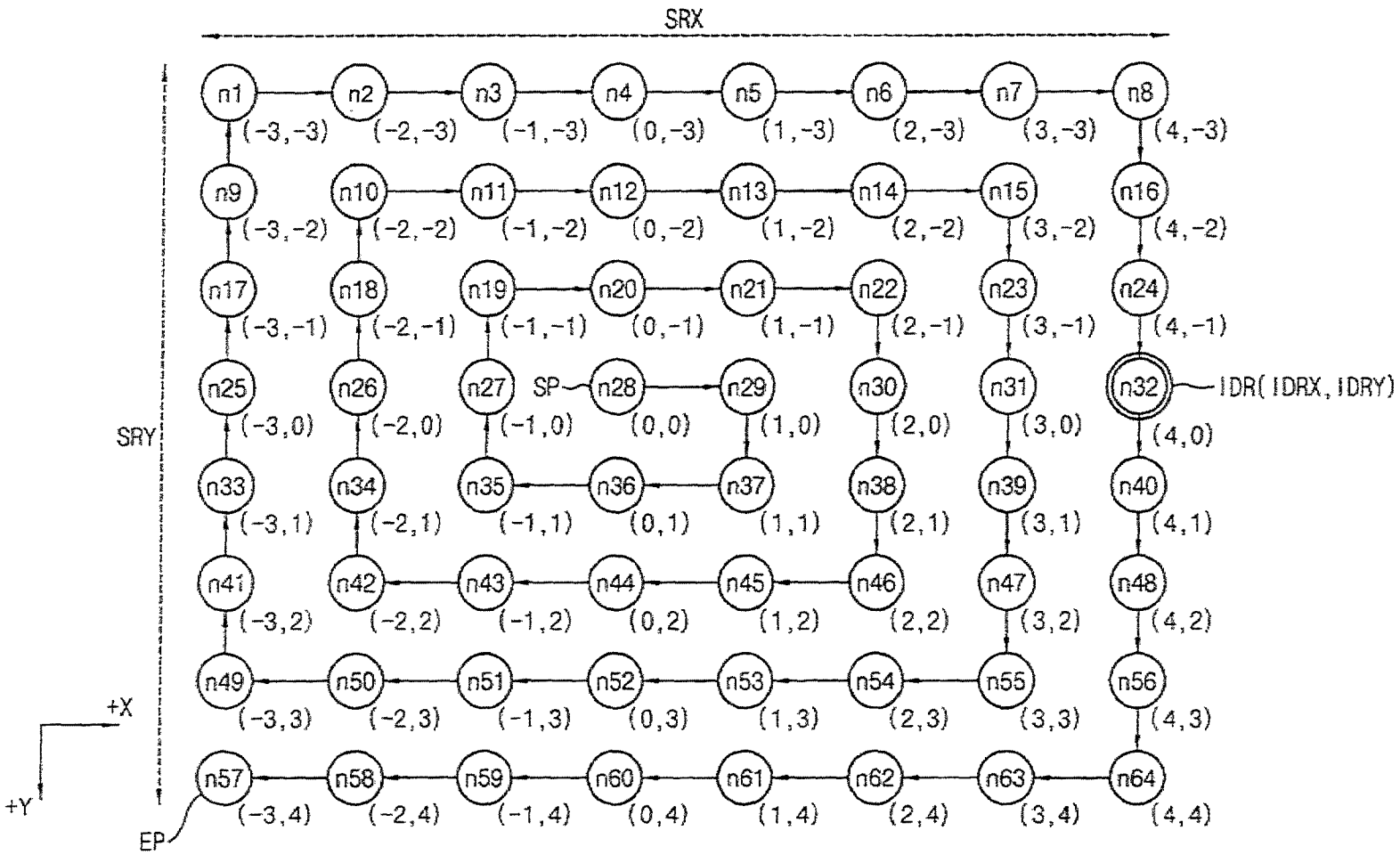

FIGS. 7 through 9 illustrate diagrams of a first shift pattern, a second shift pattern, and a third shift pattern, respectively. The shift pattern may represent a shifting trace of the image display reference coordinate IDR from a start coordinate SP to an end coordinate EP within a shift range. The image display reference coordinate IDR may include an X-axis image display reference coordinate IDRX and a Y-axis image display reference coordinate IDRY. Each of shift patterns of FIGS. 7 through 9 may include 64 coordinates n1 through n64 and shift directions between 64 coordinates n1 through n64. The shift range may include X-axis shift range SRX and Y-axis shift range SRY. FIGS. 7 through 9 shows the case that X-axis shift range SRX is 8 pixels and Y-axis shift range SRY is 8 pixels. In an example embodiment, each of X-axis shift range SRX and Y-axis shift range SRY may have a value other than 8 pixels.

According to a comparative method, the image display reference coordinate IDR may shift from the start coordinate SP n1 to the end coordinate EP n57 along the shift directions. The image display reference coordinate IDR may shift to the next coordinate every unit time. The unit time may vary from a few seconds to a few hours. In the comparative method, the image display reference coordinate IDR is initialized to a first coordinate n1 if the display device is shut down and power is restored to the display device when the image display reference coordinate IDR is a twenty-fifth coordinate n25. In this case, after-image reduction efficiency may be decreased because the image display reference coordinate IDR stays only between the first coordinate n1 and the twenty-fifth coordinate n25.

On the contrary, according to an example embodiment, generating the random value (S111) may set the random value as a natural number between 1 and 64 in FIG. 7. FIG. 7 shows a case that the random value is 8. The first shift pattern shown in FIG. 7 proceeds along a row, e.g., in a +X direction, then, at an end of the row, proceeds to an adjacent row, e.g., in a +Y direction, and along the adjacent row, e.g., in a −X direction. At an end of the adjacent row, the first shift pattern proceeds to a next adjacent row, e.g., in the +Y direction, and along the next adjacent row, e.g., in the +X direction, and so forth. Setting the image display reference coordinate as the coordinate, which corresponds to the random value, among the coordinates included in the shift pattern (S112) may initialize the image display reference coordinate IDR as an eighth coordinate n8 corresponding to the random number 8. In this case, X-axis image display reference coordinate IDRX is initialized as 7 and Y-axis image display reference coordinate IDRY is initialized as 0.

Shifting the image display reference coordinate from the random coordinate along the shift pattern (S120) may shift the image display reference coordinate IDR from the eighth coordinate n8 to a sixteenth coordinate n16, a fifteenth coordinate n15, and a fourteenth coordinate n14 sequentially along shift directions of the first shift pattern. Remaining shifting procedure may be understood based on the above. In this case, after-image reduction efficiency may be increased compared to the comparative method because the image display reference coordinate IDR travels all coordinates of the first shift pattern equally.

FIGS. 8 and 9 illustrate other example embodiments of the shift pattern. The second shift pattern of FIG. 8 and the third shift pattern of FIG. 9 may be understood based on the above description. In particular, the second shift pattern in FIG. 8 proceeds along a column, e.g., in a +Y direction, then, at an end of the column, proceeds over to an adjacent column, e.g., in a +X direction, and along the adjacent column, e.g., in a −Y direction. At an end of the adjacent column, the second shift pattern proceeds to a next adjacent column, e.g., in the +X direction, and along the next adjacent column, e.g., in the +Y direction, and so forth. In FIG. 9, the third shift pattern starts at a central coordinate, e.g., n28, and proceeds in a spiral direction, e.g., clockwise, to adjacent coordinates.

Figure 10:
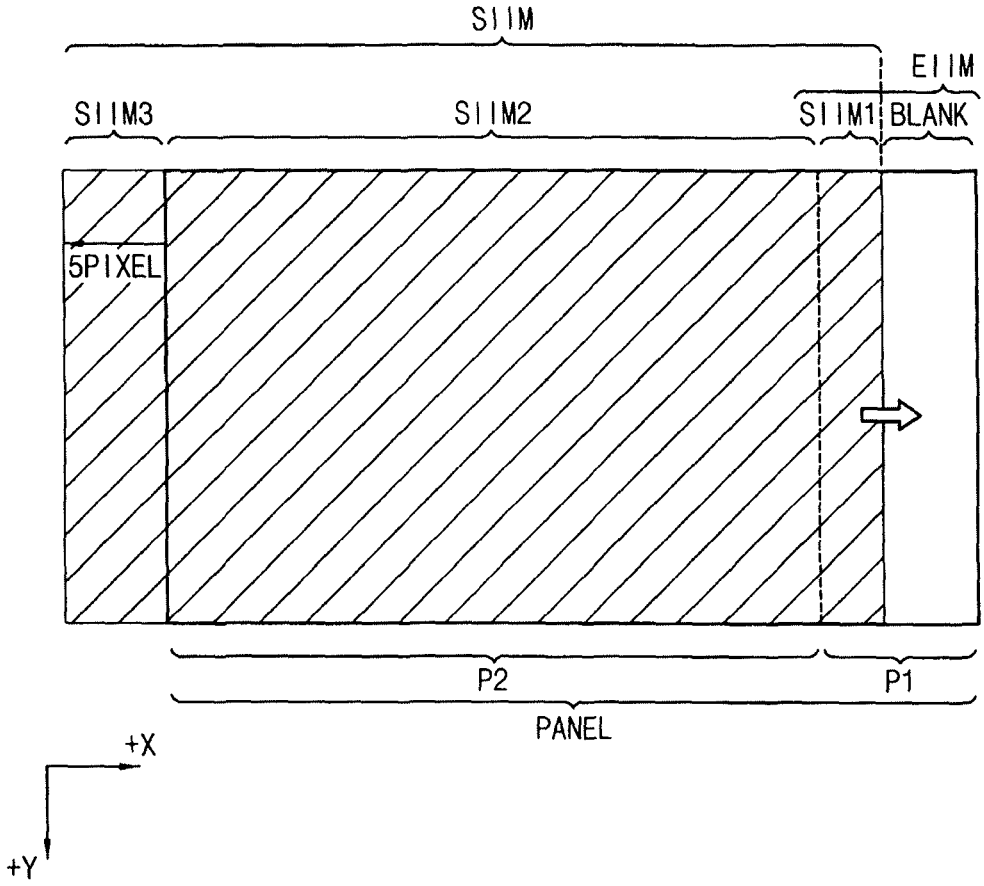
FIGS. 10 through 12 illustrate diagrams of generating the output image by processing the input image based on the image display reference coordinate included in the flow chart of FIG. 3.
Figure 11:
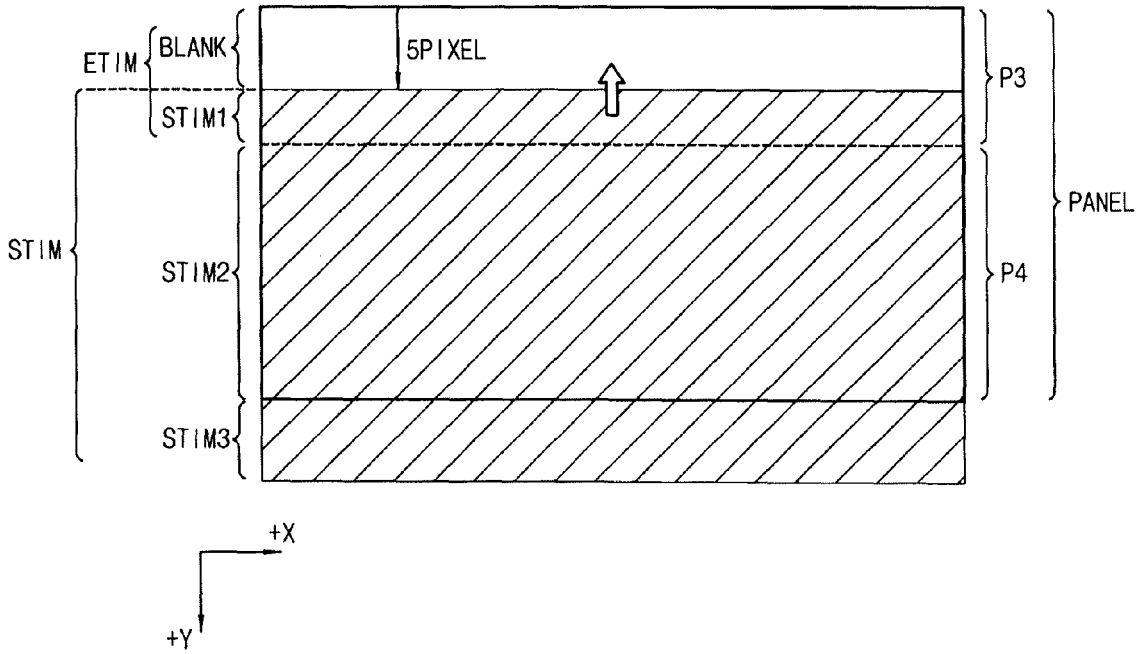
Figure 12:
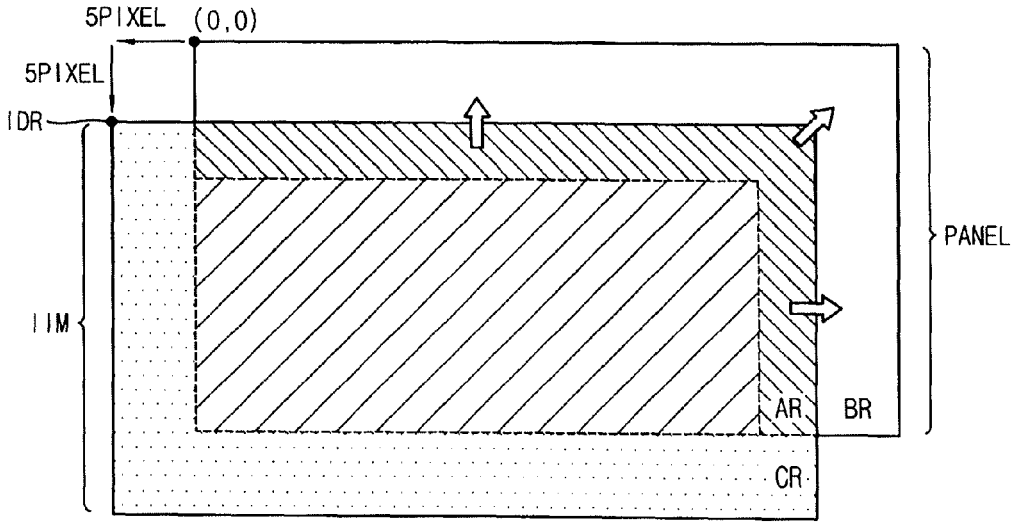

FIGS. 10 through 12 illustrate diagrams of generating the output image by processing the input image based on the image display reference coordinate included in the flow chart of FIG. 3.

FIG. 10 shows procedure of shifting and scaling the input image IIM when the image display reference coordinate IDR is (−5, 0). In this case, the input image IIM is shifted 5 pixels to −X direction compared to the display panel PANEL.

The shifted input image SIIM along the X-axis may include a first partial image SIIM1, a second partial image SIIM2, and a third partial image SIIM3. The first, second, and third partial images SIIM1, SIIM2, and SIIM3 are disposed sequentially along the X-axis. Generating the first extended partial image by extending the first partial image along the X-axis to fill the blank region of the display panel (S141) may generate the first extended partial image EIIM by extending the first partial image SIIM1 along the X-axis, e.g., in the +X direction, to fill the blank region BLANK. The blank region BLANK may be generated by the X-axis shift. Generating the internal image by adding the first extended partial image and the second partial image (S142) may generate the internal image TIM by adding the first extended partial image EIIM and the second partial image SIIM2.

The display panel PANEL may include a first region P1 and a second region P2. The first extended partial image EIIM may be displayed on the first region P1, and the second partial image SIIM2 may be displayed on the second region P2. The third partial image SIIM3 may be not displayed on the display panel PANEL.

FIG. 11 shows procedure of shifting and scaling the internal image TIM when the image display reference coordinate IDR is (0, −5). In this case, the internal image TIM is shifted 5 pixels to −Y direction compared to a panel PANEL.

The shifted internal image STIM along the Y-axis may include a first partial internal image STIM1, a second partial internal image STIM2, and a third partial internal image STIM3. Generating the first extended partial internal image by extending the first partial internal image along the Y-axis, e.g., along the +Y direction, to fill the blank region of the display panel (S143) may generate the first extended partial internal image ETIM by extending the first partial internal image STIM1 along the Y-axis to fill the blank region BLANK. The blank region BLANK may be generated by the Y-axis shift. Generating the output image by adding the first extended partial internal image and the second partial internal image (S144) may generate the output image by adding the first extended partial internal image ETIM and the second partial internal image STIM2.

The display panel PANEL may include a third region P3 and a fourth region P4. The first extended partial internal image ETIM may be displayed on the third region P3, and the second partial internal image STIM2 may be displayed on the fourth region P4. The third partial internal image STIM3 may be not displayed on the display panel PANEL.

FIG. 12 shows the procedures of FIGS. 10 and 11 combined such that the image display reference coordinate IDR is (−5, −5). A region AR included in the input image IIM may be extended to B region BR of the display panel PANEL through the procedures of FIGS. 10 and 11. C region CR included in the input image IIM may not be displayed on the display panel PANEL.

Figure 13:
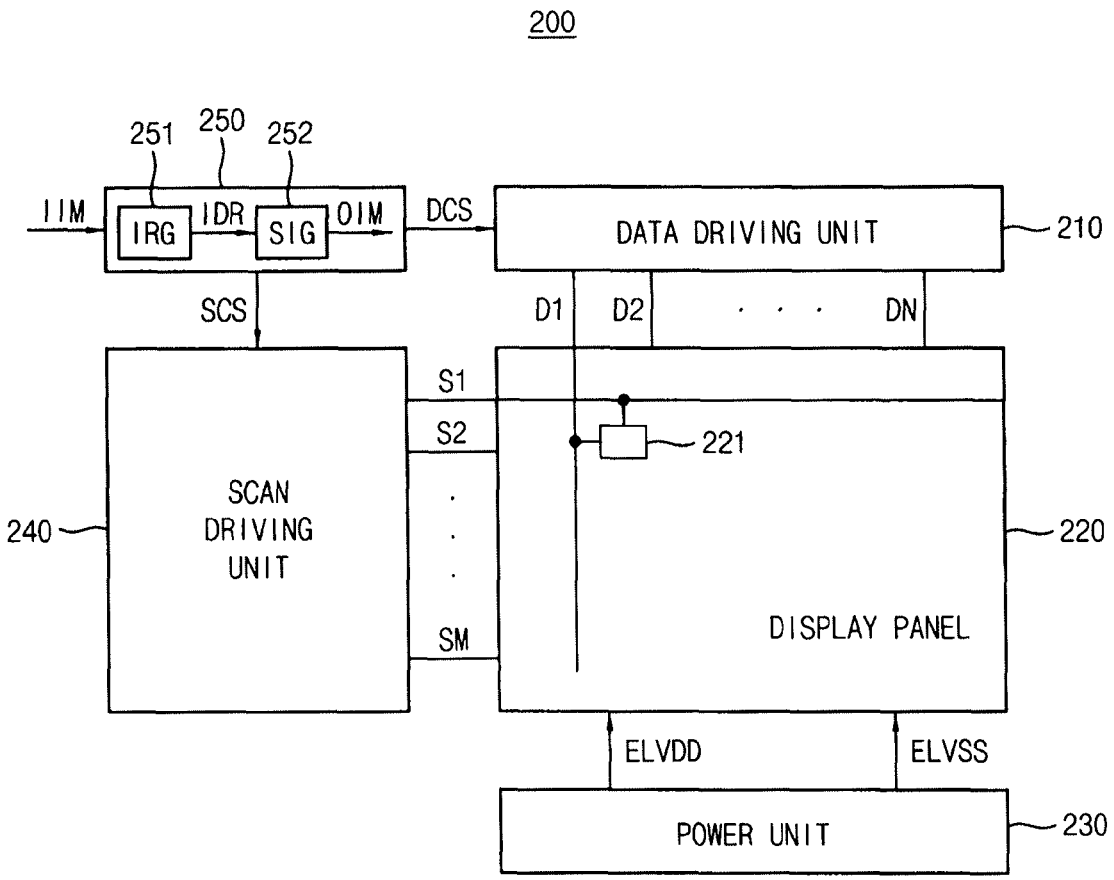
FIG. 13 illustrates a block diagram of a display device according to an example embodiment.

FIG. 13 illustrates a block diagram of a display device according to an example embodiment.

Referring to FIG. 13, a display device 200 includes a timing controller 250, a display panel, 220 a data driver 210, a scan driver 240, and a power controller 230. The timing controller 250 includes a reference coordinate generator 251 and an image processor 252. The reference coordinate generator 251 initializes an image display reference coordinate IDR as a random coordinate among coordinates included in a shift pattern when power is applied to the display device 200. The reference coordinate generator 251 shifts the image display reference coordinate IDR from the random coordinate along the shift pattern. The image processor 252 generates an output image OIM by shifting and scaling an input image JIM based on the image display reference coordinate IDR. The timing controller 250 generates a data driver control signal DCS and a scan driver control signal SCS based on the output image OIM. The display panel 220 includes a plurality of pixel circuits 221. The data driver 210 generates data signals based on the data driver control signal DCS, and provides the data signals to the pixel circuits 221 through a plurality of data lines D1, D2 through DN. The scan driver 240 generates scan signals based on the scan driver control signal SCS, and provides the scan signals to the pixel circuits 221 through a plurality of scan lines S1, S2 through SM. The power controller 230 provides a supply voltage ELVDD and a ground voltage ELVSS to the display panel 220 to operate the display panel 220.

The reference coordinate generator 251 will be described with the reference to FIG. 14, and the image processor 252 will be described with the reference to FIG. 16.

Figure 14:
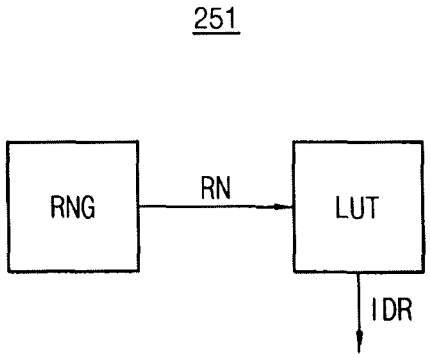
FIG. 14 illustrates a block diagram of the reference coordinate generator included in the display device of FIG. 13.

FIG. 14 illustrates a block diagram of the reference coordinate generator included in the display device of FIG. 13.

Referring to FIG. 14, the reference coordinate generator 251 may include a Radom value generator RGN and a look-up table LUT. The random value generator RNG may generate a random value RN. The look-up table LUT may store coordinates included in the shift pattern. The look-up table LUT may output a coordinate, which corresponds to the random value RN, among the coordinates as the image display reference coordinate IDR.

Figures 15, 16:
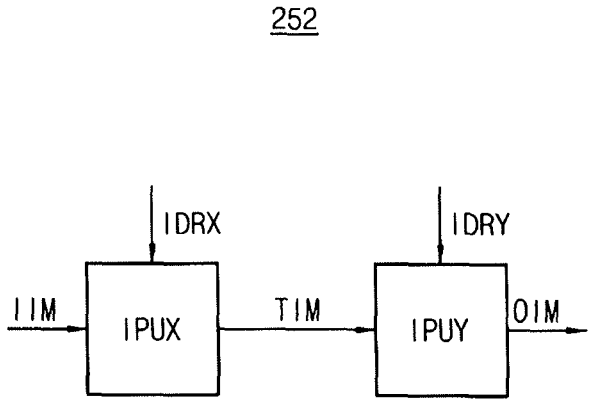
FIG. 15 illustrates a table of coordinate information stored in the look-up table included in the reference coordinate generator of FIG. 14.
FIG. 16 illustrates a block diagram of an image processor included in the display device of FIG. 13.

FIG. 15 illustrates a table of coordinate information stored in the look-up table included in the reference coordinate generator of FIG. 14.

FIG. 15 shows the case that the look-up table LUT stores coordinates included in the third shift pattern of FIG. 9. Random value RN 1 corresponds to X-axis image display reference coordinate IDRX −3 and Y-axis image display reference coordinate IDRY −3. Random value RN 2 corresponds to X-axis image display reference coordinate IDRX −2 and Y-axis image display reference coordinate IDRY −3. Random value RN 3 corresponds to X-axis image display reference coordinate IDRX −1 and Y-axis image display reference coordinate IDRY −3. Random value RN 4 corresponds to X-axis image display reference coordinate IDRX 0 and Y-axis image display reference coordinate IDRY −3. Random value RN 5 corresponds to X-axis image display reference coordinate IDRX 1 and Y-axis image display reference coordinate IDRY −3. Random value RN 62 corresponds to X-axis image display reference coordinate IDRX 2 and Y-axis image display reference coordinate IDRY 4. Random value RN 63 corresponds to X-axis image display reference coordinate IDRX 3 and Y-axis image display reference coordinate IDRY 4. Random value RN 64 corresponds to X-axis image display reference coordinate IDRX 4 and Y-axis image display reference coordinate IDRY 4.

Alternatively, the table of FIG. 15 may store coordinates included in the first shift pattern of FIG. 7, the second shift pattern of FIG. 8, or other shift patterns.

FIG. 16 illustrates a block diagram of an image processor included in the display device of FIG. 13.

Referring to FIG. 16, the image processor 252 may include an X-axis image processor IPUX and a Y-axis image processor IPUY. The X-axis image processor IPUX may shift the input image IIM along the X-axis based on the X-axis image display reference coordinate IDRX, and generate an internal image TIM by scaling the shifted input image along the X-axis. The Y-axis image processor IPUY may shift the internal image TIM along the Y-axis based on the Y-axis image display reference coordinate IDRY, and generate the output image OIM by scaling the shifted internal image along the Y-axis.

Operation of the X-axis image processor IPUX may be understood with reference to FIG. 10 and operation of the Y-axis image processor IPUY may be understood with reference to FIG. 11.

Figure 17:
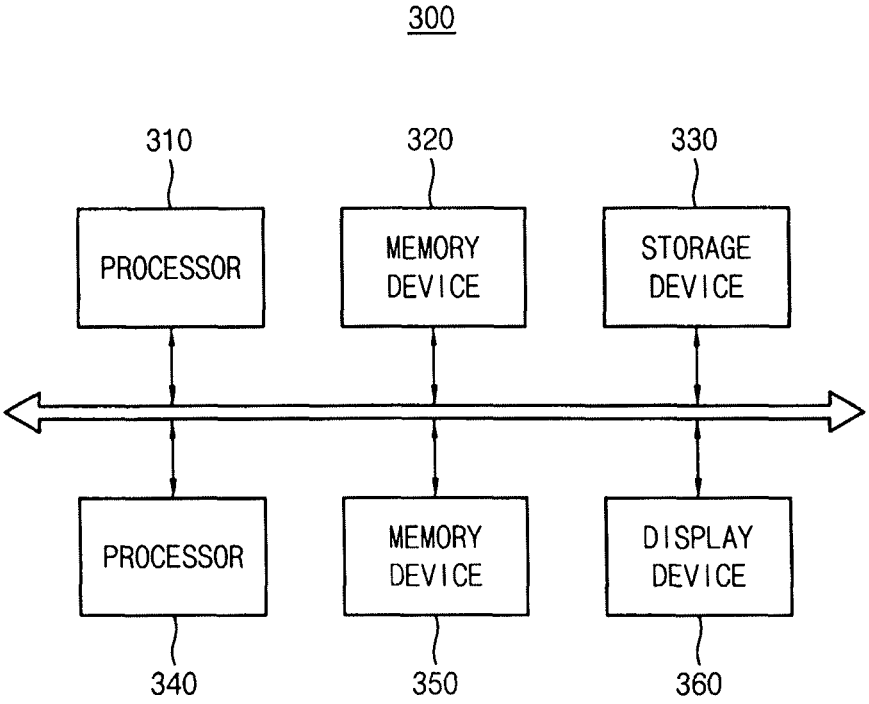
FIG. 17 illustrates a block diagram of an electronic device including a display device according to an example embodiment.

FIG. 17 illustrates a block diagram of an electronic device including a display device according to an example embodiment.

Referring to FIG. 17, an electronic device 300 may include a processor 310, a memory device 320, a storage device 330, an input/output (I/O) device 340, a power supply 350, and a display device 360. Here, the electronic device 300 may further include a plurality of ports for communicating a video card, a sound card, a memory card, a universal serial bus (USB) device, other electronic devices, etc. Although the electronic device 300 may be implemented as a smart-phone, a kind of the electronic device 300 is not limited thereto.

The processor 310 may perform various computing functions. The processor 310 may be a micro-processor, a central processing unit (CPU), etc. The processor 310 may be coupled to other components via an address bus, a control bus, a data bus, etc. Further, the processor 310 may be coupled to an extended bus such as a peripheral component interconnection (PCI) bus.

The memory device 320 may store data for operations of the electronic device 300. For example, the memory device 320 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc, and/or at least one volatile memory device such as a dynamic random access memory (DRAM) device, a static random access memory (SRAM) device, a mobile DRAM device, etc.

The storage device 330 may be a solid state drive (SSD) device, a hard disk drive (HDD) device, a CD-ROM device, etc. The I/O device 340 may be an input device such as a keyboard, a keypad, a touchpad, a touch-screen, a mouse, etc., and an output device such as a printer, a speaker, etc. The power supply 350 may provide a power for operations of the electronic device 300. The display device 360 may communicate with other components via the buses or other communication links.

The display device 360 may be the display device 200 of FIG. 13. The display device 360 may be understood based on the references to FIGS. 1 through 16.

The example embodiments may be applied to any electronic system having the display device. For example, the present embodiments may be applied to the electronic system, such as a digital or 3D television, a computer monitor, a home appliance, a laptop, a digital camera, a cellular phone, a smart phone, a personal digital assistant (PDA), a portable multimedia player (PMP), a MP3 player, a portable game console, a navigation system, a video phone, etc.

Some example embodiments provide a method of operating display device having improved after-image reduction efficiency by shifting an image display reference coordinate from a random coordinate in a shift pattern when power is applied to the display device.

As described above, a method of operating a display device according to an example embodiment may improve after-image reduction efficiency of the display device by shifting an image display reference coordinate from a random coordinate in a shift pattern when power is applied to the display device compared to a comparative method shifting the image display reference coordinate from a fixed coordinate in the shift pattern.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the present invention as set forth in the following claims.

What is claimed is:

1. A method of operating a display device, comprising:

initializing an image display reference coordinate as a random coordinate among coordinates included in a shift pattern when power is applied to the display device;

shifting the image display reference coordinate from the random coordinate along the shift pattern; and displaying an input image to a display panel included in the display device based on the image display reference coordinate.

2. The method as claimed in claim 1, wherein initializing the image display reference coordinate as the random coordinate among coordinates included in the shift pattern when the power is applied to the display device includes:

generating a random value; and setting the image display reference coordinate as a coordinate, which corresponds to the random value, among the coordinates included in the shift pattern.

3. The method as claimed in claim 1, wherein the shift pattern represents a shifting trace of the image display reference coordinate from a start coordinate to an end coordinate within a shift range.

4. The method as claimed in claim 1, wherein displaying the input image on the display panel included in the display device based on the image display reference coordinate includes:

generating an output image by processing the input image based the image display reference coordinate; and displaying the output image on the display panel.

5. The method as claimed in claim 4, wherein the image display reference coordinate includes an X-axis image display reference coordinate and a Y-axis image display reference coordinate.

6. The method as claimed in claim 5, wherein generating the output image by processing the input image based on the image display reference coordinate includes:

shifting the input image along the X-axis based on the X-axis image display reference coordinate;

generating an internal image by scaling the shifted input image along the X-axis;

shifting the internal image along the Y-axis based on the Y-axis image display reference coordinate; and generating the output image by scaling the shifted internal image along the Y-axis.

7. The method as claimed in claim 6, wherein:

the shifted input image along the X-axis includes a first partial image, a second partial image, and a third partial image, the first, second, and third partial images are disposed sequentially along the X-axis, and the third partial image is not displayed on the display panel.

8. The method as claimed in claim 7, wherein generating the internal image by scaling the shifted input image along the X-axis includes:

generating a first extended partial image by extending the first partial image along the X-axis to fill a blank region of the display panel, the blank region being generated by the X-axis shift; and generating the internal image by adding the first extended partial image and the second partial image.

9. The method as claimed in claim 6, wherein:

the shifted internal image along the Y-axis includes a first partial internal image, a second partial internal image, and a third partial internal image, the first, second, and third partial internal images are disposed sequentially along the Y-axis, and the third partial internal image is not displayed on the display panel.

10. The method as claimed in claim 9, wherein generating the output image by scaling the shifted internal image along the Y-axis includes:

generating a first extended partial internal image by extending the first partial internal image along the Y-axis to fill a blank region of the display panel, the blank region being generated by the Y-axis shift; and generating the output image by adding the first extended partial internal image and the second partial internal image.

11. A display device, comprising:

a timing controller including a reference coordinate generator and an image processor, the reference coordinate generator to initialize an image display reference coordinate as a random coordinate among coordinates included in a shift pattern when power is applied to the display device, the reference coordinate generator to shift the image display reference coordinate from the random coordinate along the shift pattern, the image processor to generate an output image by shifting and scaling an input image based on the image display reference coordinate, the timing controller to generate a data driver control signal and a scan driver control signal based on the output image;

a display panel including a plurality of pixel circuits;

a data driver to generate data signals based on the data driver control signal, and provide the data signals to the pixel circuits through a plurality of data lines;

a scan driver to generate scan signals based on the scan driver control signal, and provide the scan signals to the pixel circuits through a plurality of scan lines; and a power controller to provide a supply voltage and a ground voltage to the display panel to operate the display panel.

12. The display device as claimed in claim 11, wherein the reference coordinate generator includes:

a random value generator to generate a random value; and a look-up table (LUT) storing coordinates included in the shift pattern, the look-up table to output a coordinate, which corresponds to the random value, among the coordinates as the image display reference coordinate.

13. The display device as claimed in claim 11, wherein the shift pattern represents a shifting trace of the image display reference coordinate from a start coordinate to an end coordinate within a shift range.

14. The display device as claimed in claim 11, wherein the image display reference coordinate includes an X-axis image display reference coordinate and a Y-axis image display reference coordinate.

15. The display device as claimed in claim 14, wherein the image processor includes:

an X-axis image processor to shift the input image along the X-axis based on the X-axis image display reference coordinate and to generate an internal image by scaling the shifted input image along the X-axis; and a Y-axis image processor to shift the internal image along the Y-axis based on the Y-axis image display reference coordinate and to generate the output image by scaling the shifted internal image along the Y-axis.

* * * * *